US007970297B2

(12) United States Patent
Inoue et al.

(10) Patent No.: US 7,970,297 B2
(45) Date of Patent: Jun. 28, 2011

(54) POWDER CONTAINER AND IMAGE FORMING APPARATUS

(75) Inventors: Tomofumi Inoue, Osaka (JP); Kohji Hatayama, Kanagawa (JP); Takeshi Sakashita, Osaka (JP); Mitsutoshi Kichise, Osaka (JP); Yuuji Meguro, Ibaraki (JP); Takeru Muramatsu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 714 days.

(21) Appl. No.: 12/007,681

(22) Filed: Jan. 14, 2008

(65) Prior Publication Data

US 2008/0193167 A1 Aug. 14, 2008

(30) Foreign Application Priority Data

Jan. 16, 2007 (JP) ..... 2007-006896

(51) Int. Cl.
*G03G 21/12* (2006.01)

(52) U.S. Cl. ..... 399/35; 399/360

(58) Field of Classification Search ..... 399/35, 399/120, 358, 360
See application file for complete search history.

(56) References Cited

U.S. PATENT DOCUMENTS 6,587,661 B1 * 7/2003 Shimmura et al. ..... 399/257

FOREIGN PATENT DOCUMENTS

| | | |
|---|---|---|
| JP | 11-002947 | 1/1999 |
| JP | 11-305623 | 11/1999 |
| JP | 2000-056648 | 2/2000 |
| JP | 2000-075747 | 3/2000 |
| JP | 2004-286790 | 10/2004 |
| JP | 2005-283626 | 10/2005 |
| JP | 2005-352402 | 12/2005 |
| JP | 2007-178947 | 7/2007 |

* cited by examiner

*Primary Examiner* — David M Gray
*Assistant Examiner* — Gregory H Curran
(74) *Attorney, Agent, or Firm* — Harness, Dickey & Pierce, P.L.C.

(57) ABSTRACT

A powder conveying unit conveys powder input from a powder inlet of a powder containing chamber into the powder containing chamber. A powder detecting unit detects a full state of the powder conveyed by the powder conveying unit in the powder containing chamber. A sensor chamber is provided outside the powder containing chamber connected with each other. The powder detecting unit is provided in the sensor chamber, a bottom surface of the sensor chamber is at higher level than a bottom surface of the powder containing chamber, and the bottom surface of the sensor chamber is inclined downward toward the powder containing chamber.

19 Claims, 10 Drawing Sheets

POWDER CONTAINER AND IMAGE FORMING APPARATUS

CROSS-REFERENCE TO RELATED APPLICATIONS

The present application claims priority to and incorporates by reference the entire contents of Japanese priority document, 2007-006896 filed in Japan on Jan. 16, 2007.

BACKGROUND OF THE INVENTION

1. Field of the Invention

The present invention relates to a powder container for collecting and accumulating powder such as waste toner, and an image forming apparatus including the powder container.

2. Description of the Related Art

In image forming apparatuses such as a copier, toner that has not been transferred and remains on a photosensitive drum or an intermediate transfer belt that transfers a toner image to a recording medium or intermediate transfer body is eliminated by a cleaning mechanism, collected, and accumulated in a powder collecting box.

The powder collecting box includes a toner entrance connected to the cleaning mechanism, a toner conveyor that transports toner charged in the box, and a toner detector that detects the degree of storage (filling rate) of the toner in the box. When it is detected by the toner detector that the box is full of toner, the powder collecting box is replaced.

To enhance user's convenience, the number of replacing the powder collecting box is desirably as small as possible and the capacity of the box is thus as large as possible. As is commonly known, in the image forming apparatuses, compactness and cost reduction have progressed. Actually, the box cannot be enlarged only to improve the powder collecting capability.

The powder collecting box is usually placed in a so-called dead space such as between a feeding unit placed at the bottom of the image forming apparatus main body and an image forming unit placed above the feeding unit.

If there is not much room for the image forming apparatus main body in the height direction because of its compactness, the powder collecting box needs to be made to be extend in the longitudinal and transverse directions (X and Y directions) and reduced in the height direction (Z direction). The powder collecting box thus tends to be made in a flat box shape that extends in the horizontal direction and has a low height.

It is significantly difficult to accumulate toner uniformly in the flat box. The toner can be accumulated in a partially solidified state. If the solidified toner is accumulated near the toner detector, the full state of the box is detected despite the box is not full. The box that does not reach its full state is required to be replaced earlier, resulting in a decrease in user's convenience.

A conveyor that transports and equalizes toner needs to be provided in the powder collecting box and toner cartridges having such conveyor are disclosed (see, for example, Japanese Patent Application Laid-open No. H11-2947). In the toner cartridge disclosed in Japanese Patent Application Laid-open No. H11-2947, an eccentric cam is provided at the shaft of a screw for supplying toner externally, a plate is reciprocated by the eccentric cam in the horizontal direction, and toner is conveyed by internally directed protrusions with truncated V-shaped configurations that are integrally formed at the plate. The cartridge is provided to supply toner efficiently to the last while preventing aggregation of the accumulated toner. While the conveying directions of the protrusions that are placed in the truncated V-shaped configuration and serve as conveying members are crossing with each other and different as shown in FIG. 7 of the above patent document, the toner is unidirectionally directed to the toner detector by the interaction of the protrusions. A unit that detects the remaining amount of toner is provided in the cartridge.

However, flow and pulsation of the accumulated toner are generated by the internal conveyor in the toner cartridge with the above configuration. The sensor that detects the amount of toner can be also affected thereby, and detection accuracy is significantly decreased.

SUMMARY OF THE INVENTION

It is an object of the present invention to at least partially solve the problems in the conventional technology.

According to an aspect of the present invention, there is provided a powder container includes a powder containing chamber including a powder inlet; a powder conveying unit that conveys powder input from the powder inlet of the powder containing chamber into the powder containing chamber; and a powder detecting unit that detects a full state of the powder conveyed by the powder conveying unit in the powder containing chamber. A sensor chamber is provided outside the powder containing chamber connected with each other. The powder detecting unit is provided in the sensor chamber, a bottom surface of the sensor chamber is at higher level than a bottom surface of the powder containing chamber, and the bottom surface of the sensor chamber is inclined downward toward the powder containing chamber.

Furthermore, according to another aspect of the present invention, there is provided an image forming apparatus that forms an image on a recording medium in an electrophotographic manner. The image forming apparatus includes a powder container including a powder containing chamber including a powder inlet, a powder conveying unit that conveys powder input from the powder inlet of the powder containing chamber into the powder containing chamber, and a powder detecting unit that detects a full state of the powder conveyed by the powder conveying unit in the powder containing chamber. A sensor chamber is provided outside the powder containing chamber connected with each other. The powder detecting unit is provided in the sensor chamber, a bottom surface of the sensor chamber is at higher level than a bottom surface of the powder containing chamber, and the bottom surface of the sensor chamber is inclined downward toward the powder containing chamber.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
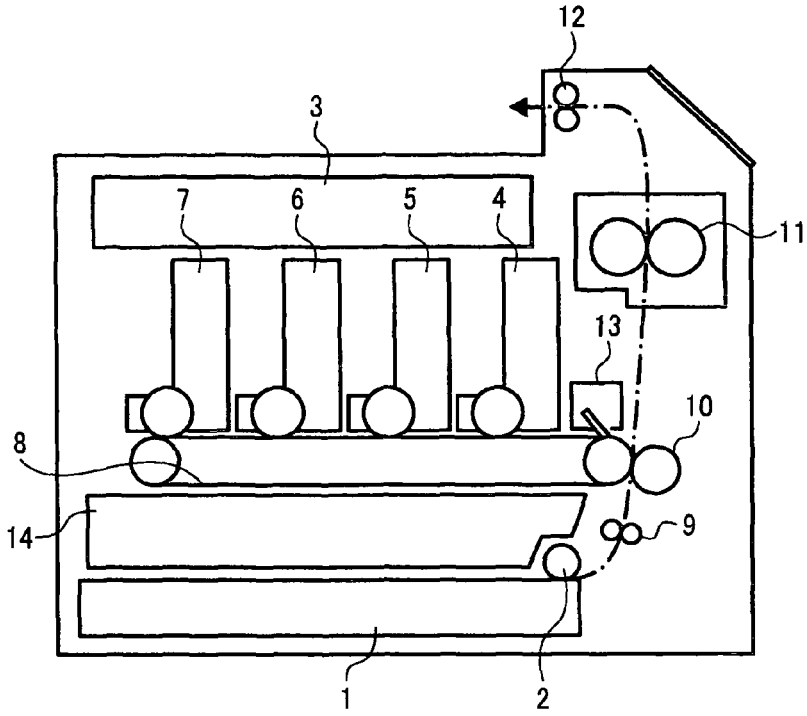
FIG. 1 is a schematic diagram of the overall configuration of an image forming apparatus according to an embodiment of the present invention.

FIG. 1 is a schematic diagram of the overall configuration of an image forming apparatus according to an embodiment of the present invention. In the image forming apparatus, an exposure unit 3 performs optical writing upon four image forming units 4 to 7 placed in the substantially horizontal direction, so that electrostatic latent images are formed. The electrostatic latent images are visualized by the development devices of the image forming units, superimposed on an intermediate transfer belt 8, and transferred. A transfer sheet stacked in a feed cassette 1 is fed by a feed roller 2, has its oblique misregistration corrected by a registration roller 9, and then is transported to a secondary transfer section at a predetermined timing. In the secondary transfer section, the toner images are transferred to the transfer sheet at the same time by a secondary transfer roller 10. The toner images are fixed on the transfer sheet as an image in a fixing unit 11, and the sheet is outputted by a discharge roller 12. Residual toner remaining on the intermediate transfer belt 8 is eliminated by a cleaning mechanism 13, collected, and accumulated in a powder collecting box 14 serving as a powder container.

Figure 2:
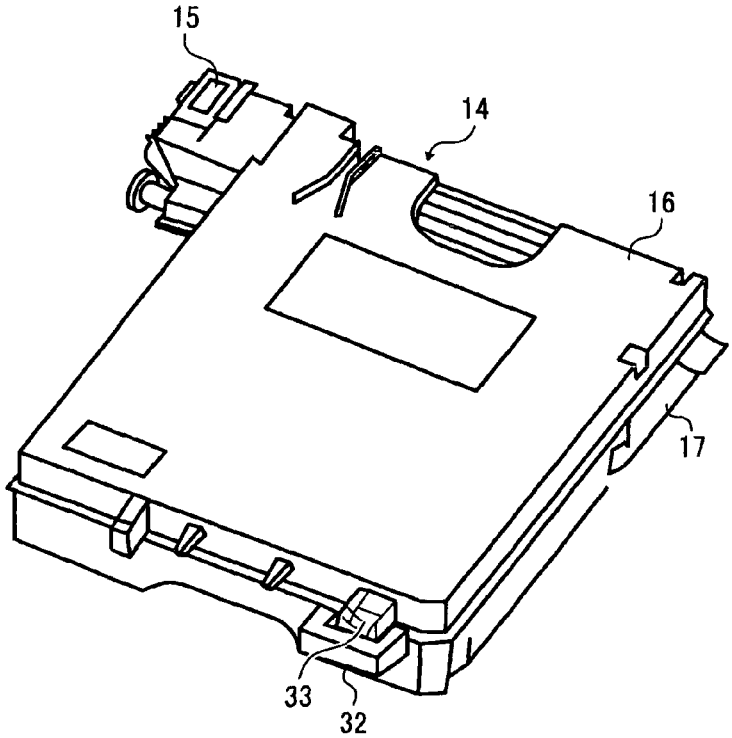
FIG. 2 is a perspective view of a powder collecting box incorporated in the image forming apparatus.
Figure 3:
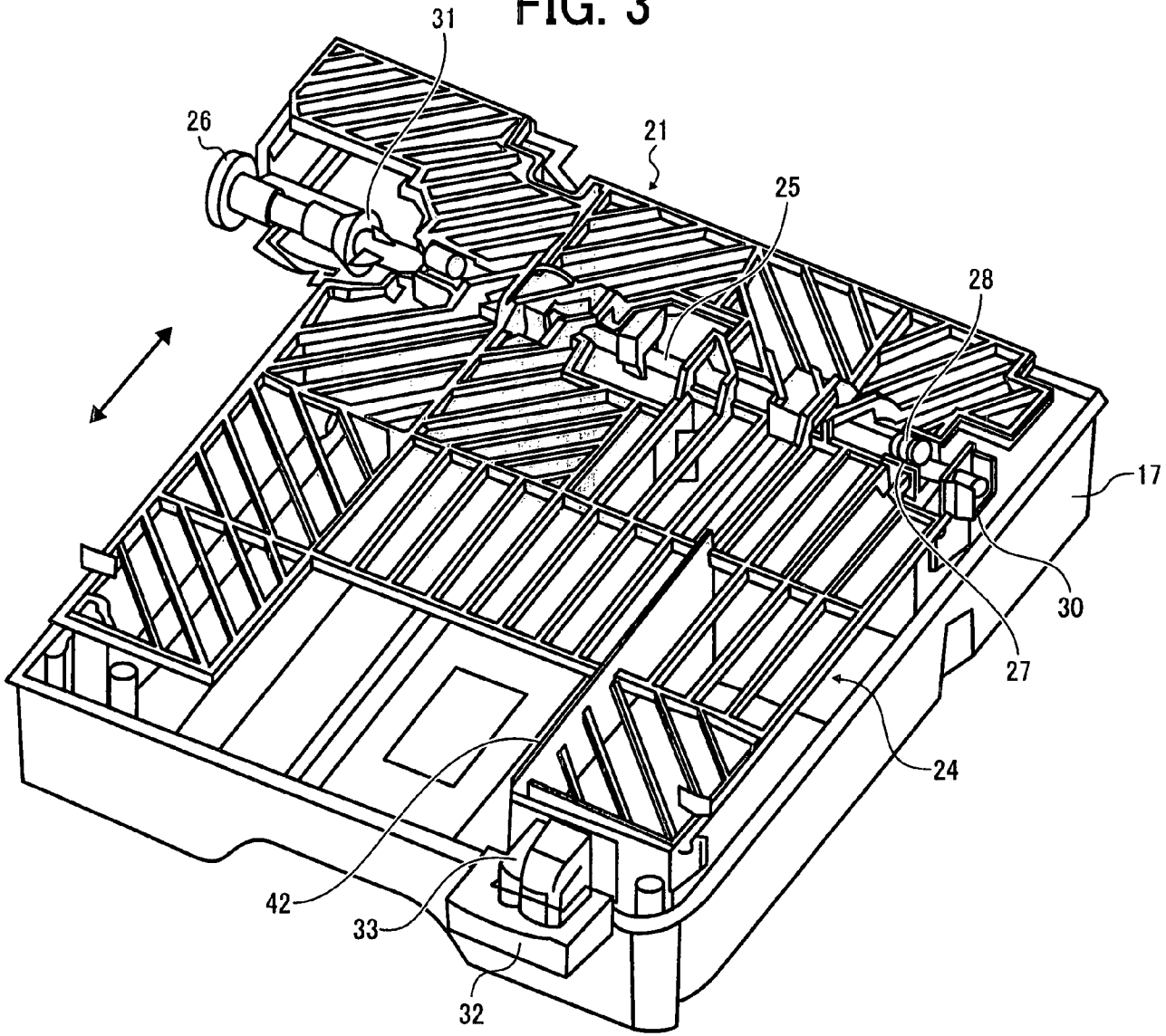
FIG. 3 is a perspective view of the powder collecting box (a lower case) shown in FIG. 2 with its upper case removed.
Figure 4:
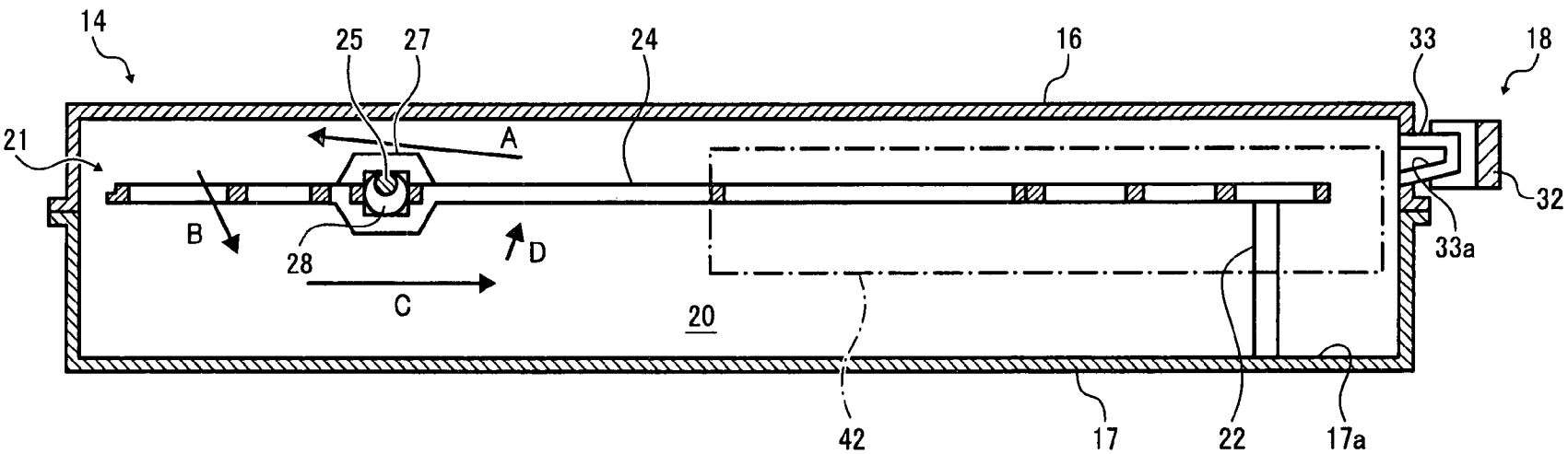
FIG. 4 is a schematic side cross-section of the powder collecting box seen from a drive gear side.
Figure 5:
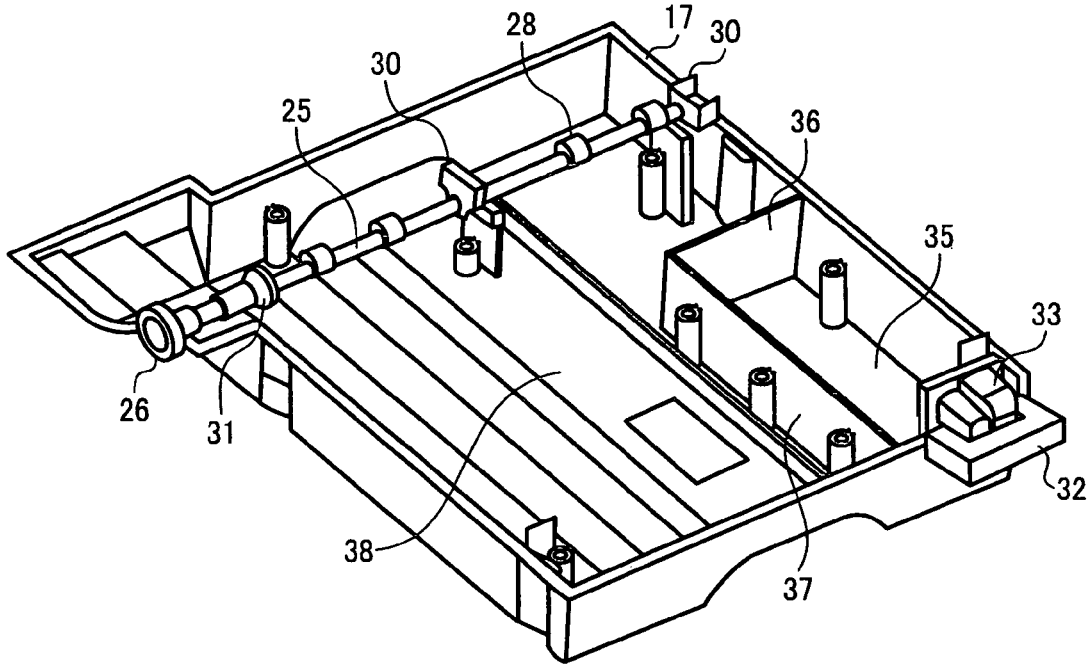
FIG. 5 is a perspective view of the lower case shown in FIG. 3 with its stirring/conveying plate removed, seen from another angle.

FIG. 2 is a perspective view of the powder collecting box incorporated in the image forming apparatus. FIG. 3 is a perspective view of the powder collecting box shown in FIG. 2 with its upper case removed. FIG. 4 is a schematic side cross-section of the powder collecting box. FIG. 5 is a perspective view of a lower case shown in FIG. 3 with its stirring/conveying plate removed, seen from another angle. As shown in these drawings, the powder collecting box 14 is formed in a box shape with substantially rectangular flat surfaces and has an upper case 16 with a powder inlet 15, a lower case 17, and a powder-full detecting unit 18. A powder transporting hose extending from the cleaning mechanism 13 (not shown) is connected to the powder inlet 15 that allows the powder to be charged.

A powder containing chamber 20 is formed in the powder collecting box 14 and a powder conveying unit 21 is placed in the powder containing chamber 20. The powder conveying unit 21 includes a stirring/conveying plate 24 that is supported by a plurality of support protrusions 22 provided on a bottom surface 17*a* of the lower case 17 at its lower surface on the distal end side and that is placed to substantially reciprocate along the horizontal directions as indicated by the arrows in FIG. 3, a camshaft 25 engaging with the stirring/conveying plate on the proximal end side, a drive gear 26 fixed to an end of the camshaft 25 protruding outside the powder collecting box 14 and connected to the drive source (not shown) of the image forming apparatus, and an eccentric cam 28 provided at the camshaft 25 inside the powder collecting box 14 and accommodated in a cam receiver 27 integrally formed with the stirring/conveying plate 24.

The camshaft 25 is rotatably supported by a plurality of supporting pieces 30 integrally formed with the lower case 17, cut on the drive gear 26 side, and connected together by a coupling 31.

Figure 6:
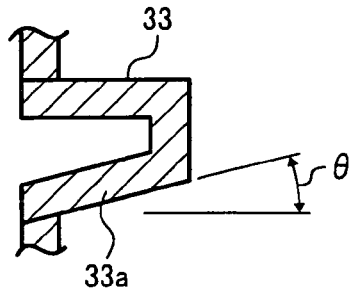
FIG. 6 is an enlarged diagram of a cross-sectional configuration of a sensor chamber.

The powder-full detecting unit 18 is placed to be opposed substantially diagonally to the powder inlet 15 of the powder collecting box 14 and includes a sensor 32 serving as a powder detecting unit in a sensor chamber 33. As shown in FIG. 6, walls constituting the sensor chamber 33 are protruded integrally outside from the sidewall of the upper case 16. The sensor chamber 33 is open on the powder containing chamber 20 side to communicate with the powder containing chamber 20, so that toner conveyed from the powder inlet 15 toward the sensor chamber 33 enters the sensor chamber naturally when the powder containing chamber 20 is almost full of toner. A bottom surface 33*a* of the sensor chamber 33 is placed far above the bottom surface of the lower case 17. As shown in FIG. 4, the bottom surface 33*a* of the sensor chamber 33 is substantially on the same level as the upper surface of the stirring/conveying plate 24 placed above slightly the height direction intermediate of the powder containing chamber 20. Toner does not enter the sensor chamber 33 unless the required amount of toner is accumulated in the powder containing chamber 20.

Further, the bottom surface 33*a* of the sensor chamber 33 is formed to be inclined downward toward the powder containing chamber 20. Toner pulsates by the substantial reciprocating movement of the stirring/conveying plate 24 to be transported in a mass at a time, so that the toner level is increased and the toner enters the sensor chamber 33. The toner then slides down the inclined surface to be returned to the average inclined surface level of toner. The full state is thus detected at the more accurate amount of toner. An inclined angle $\theta$ of the bottom surface 33*a* of the sensor chamber 33 is larger than a resting angle of the toner stored in the powder containing chamber 20 as shown in FIG. 6. Sliding down of the toner is thus ensured. For the sensor 32, e.g., a light transmitting photosensor or reflective photosensor is utilized.

The sensor 32 is placed in the sensor chamber 33 that is separate from the powder containing chamber 20 to be far from the powder conveying unit 21 placed in the powder containing chamber 20. The sensor 32 is thus not affected by the toner flow and pulsation caused by the powder conveying unit 21. Unlike conventional cases that the sensor is provided in the powder containing chamber, a significant decrease in detection accuracy due to the toner flow and pulsation by the powder conveying unit 21 does not occur.

Further, as shown in FIG. 5, partitions 36 and 37 constituting a rectangular toner storing/accumulating chamber 35 with the sidewall of the lower case 17 for the powder collecting box 14 are provided in the powder containing chamber 20 near the sensor chamber 33. The conveyed toner does not enter the sensor chamber 33 unless the required amount of toner is accumulated in the powder containing chamber 20 and then the toner storing/accumulating chamber 35.

In addition to the partitions 36 and 37 separately provided, the partition is provided by making the bottom surface of the powder containing chamber 20 convex like a convex portion 38 shown in FIG. 5. As the partition is provided by making the bottom surface of the powder containing chamber 20 convex, a concave portion is formed on the outer surface of the powder containing chamber 20. Components around the waste toner box, e.g., a feed roller can enter the concave portion. The apparatus is thus made compact. Alternatively, the powder collecting box 14 with a larger volume is formed.

Figure 7:
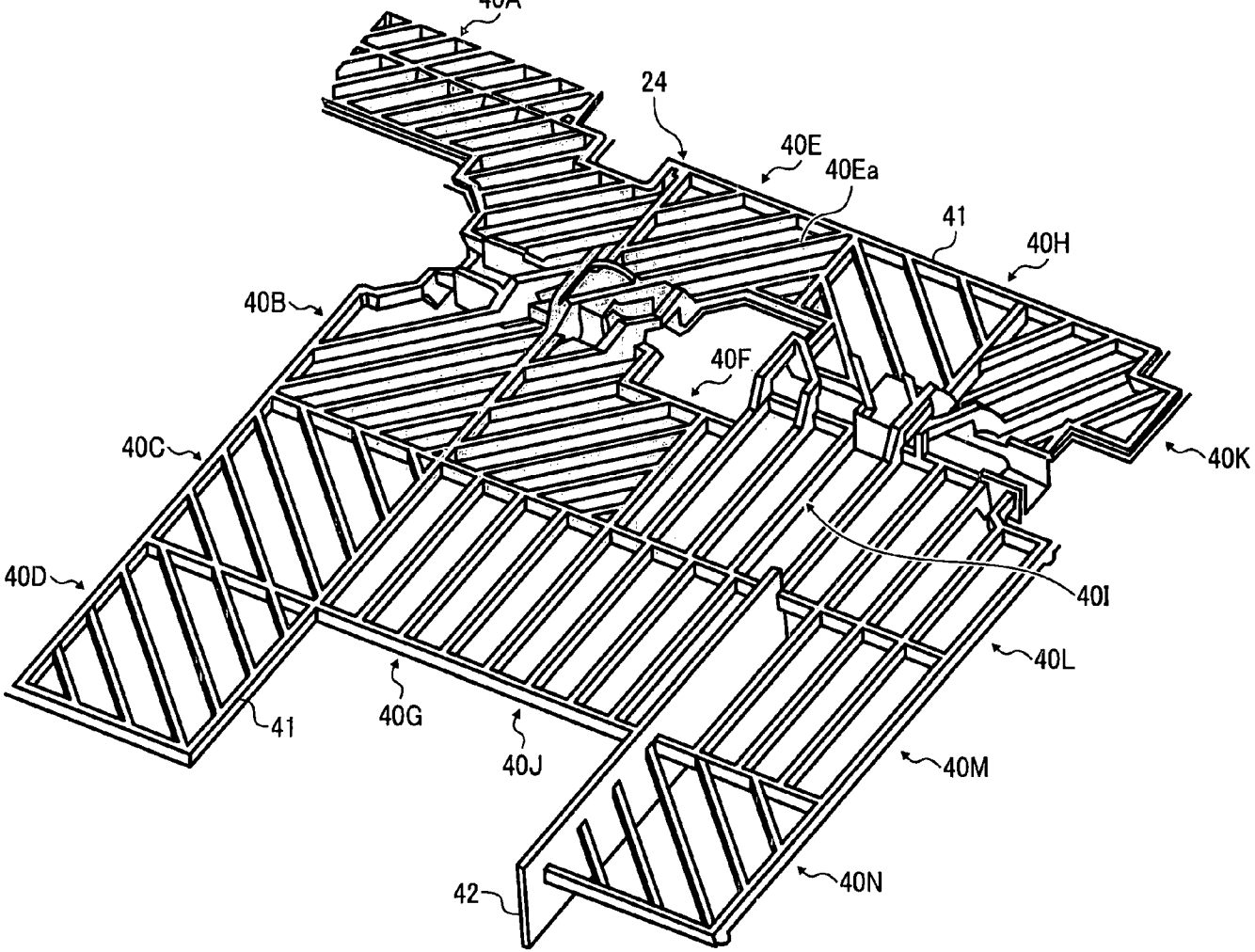
FIG. 7 is a perspective view of the stirring/conveying plate.

As shown in FIG. 7, the stirring/conveying plate 24 is made integrally of synthetic resin and has a plurality of conveyors 40A, 40B, 40C, . . . , 40N placed at the different positions on the substantially horizontal plane. Each of the conveyors 40 is partitioned in a rectangular shape by ribs 41 extending in the longitudinal and transverse directions, and formed of conveying members (e.g., 40Ea for conveyor 40E) made by arranging a plurality of shuttering boards for pushing and moving toner in parallel with each other at angles with respect to the directions the stirring/conveying plate 24 moves (directions indicated by the arrow in FIG. 3) on the substantially horizontal plane. The conveying members are placed to be obliquely cross or orthogonal to the camshaft 25 with the substantially same distances therebetween and the space between the conveying members is formed as a groove. The conveyors 40 include four types of conveying members, i.e., an obliquely crossing conveyor 40BA that covers the powder inlet 15 and has a narrow groove, obliquely crossing conveyors 40BB, 40E, 40F, and 40K with wider grooves, conveyors 40BC, 40D, 40H, and 40N that cross obliquely the camshaft in the opposite direction to that of the conveyors 40BB, 40E, 40F, and 40K, and orthogonally crossing conveyors 40BG, 40I, 40J, 40L, and 40M.

The distances between the shuttering boards for pushing and moving toner used for the conveyors 40 are different, so that the amounts of toner moving in the conveyors 40 are different. As the distance between the shuttering boards becomes wider, the number of the shuttering boards in the conveyors 40 is reduced and the amount of toner moved by the conveyors 40 is also reduced. A partition 42 extending in the direction orthogonal to the camshaft 25 is formed integrally to extend between the upper and lower surfaces of the conveyors 40M and 40L on the side of the conveyor 40J. That is, the partition 42 regulates upper and lower flows of powder between the conveyor 40J side and the conveyors 40M and 40N side and their amounts. The partition 42 prevents the conveyed toner from flowing from the powder containing chamber 20 to the toner storing/accumulating chamber 35 before the powder containing chamber 20 becomes full. The partition 42 is thus placed to abut against the toner flow caused by the conveyor 40J, as shown in FIG. 7.

In other words, while the heights of the partitions 36 and 37 need to be increased to enhance their effects (or when the heights of the partitions are not high sufficiently), the space for the stirring/conveying plate 24 to reciprocate substantially is required. The heights of the partitions thus should be determined not to reach the space. As shown in FIG. 7, the partition 42 is provided at the stirring/conveying plate 24, which achieves the same effects as the case that the heights of the partitions 36 and 37 are increased. The prevention of wrong detection of full state at low capacity is improved.

Figure 8:
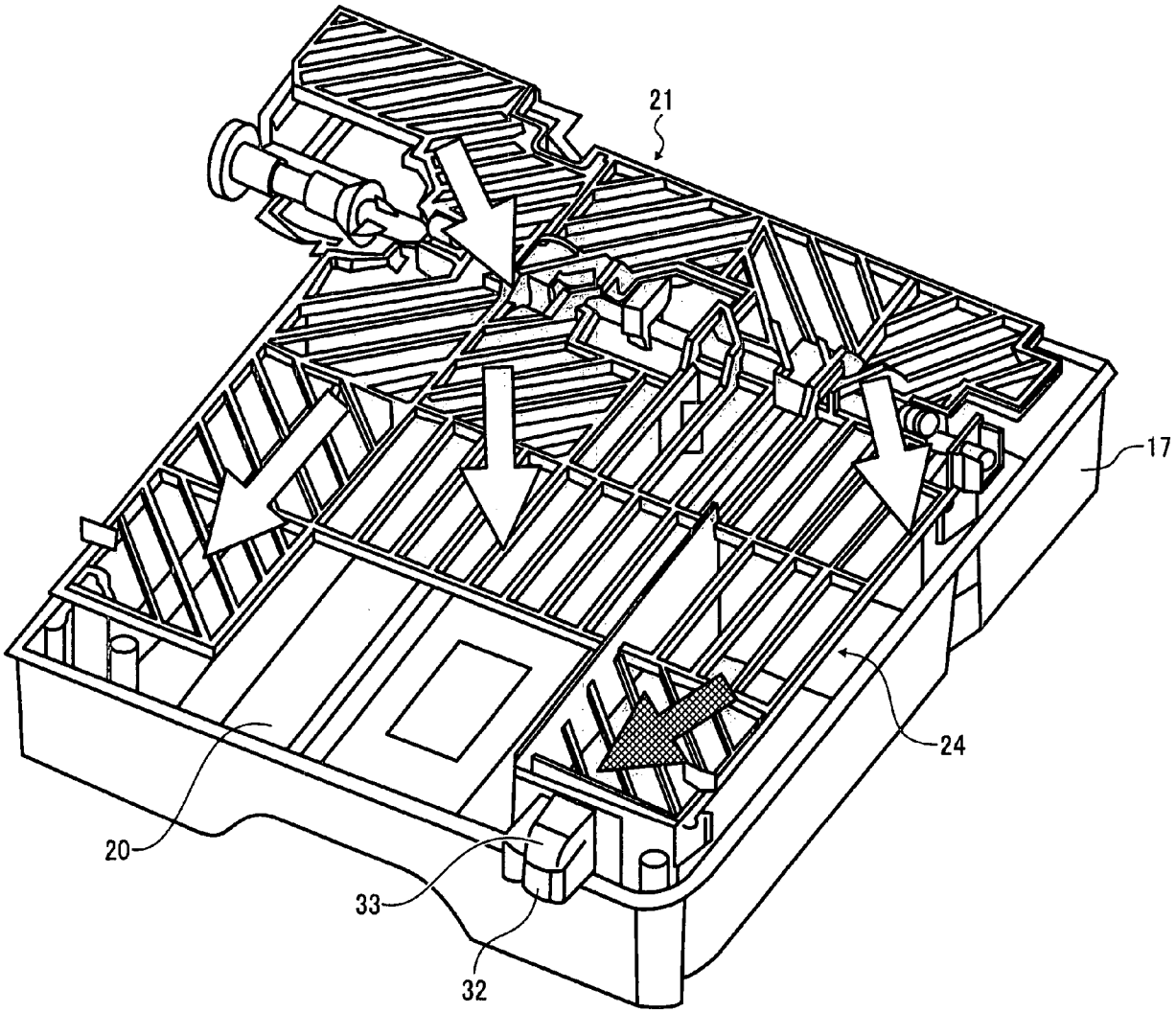
FIG. 8 is a schematic diagram for explaining an operation of a conveyor of the stirring/conveying plate.
Figure 9:
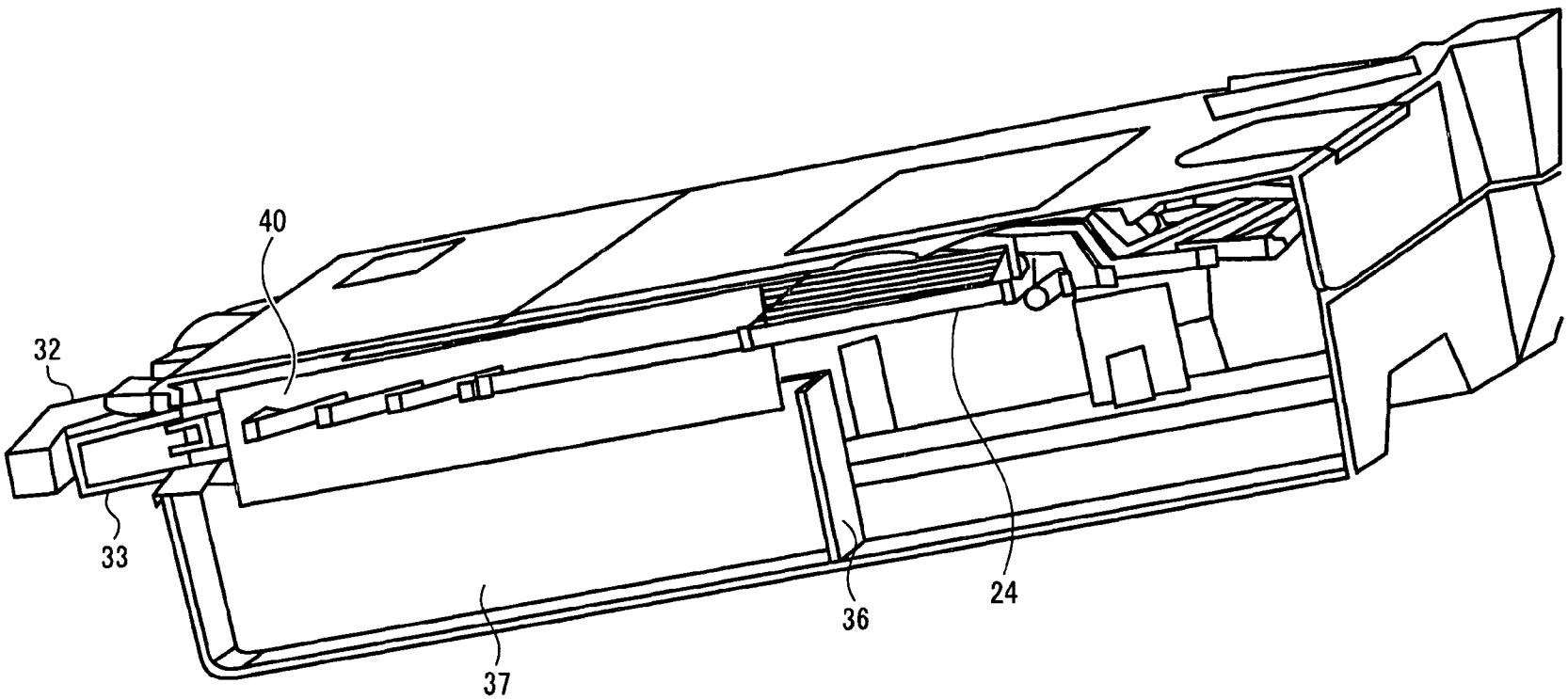
FIG. 9 is an internal perspective view of the powder collecting box seen from a direction of a partition.

As shown in FIG. 4, when the large diameter portion of the eccentric cam 28 rotates counterclockwise, the stirring/conveying plate 24 moves left in the drawing while floating upward as indicated by the arrow A, lower right as indicated by the arrow B, right in the substantially horizontal direction as indicated by the arrow C, and upper right as indicated by the arrow D according to the phase of large diameter portion of the eccentric cam 28 with respect to the cam receiver 27. Such movements are repeated resulting in the substantial reciprocating movement. The distal end side of the stirring/conveying plate 24 slides on the support protrusions 22, as described above. When the stirring/conveying plate 24 moves forward (in the direction of the arrow C in FIG. 4), it moves along the bottom surface of the lower case 17 and the conveyors 40 push to move the toner accumulated in the powder containing chamber. When the stirring/conveying plate 24 moves backward (in the directions of the arrows D and A in FIG. 4), it moves to be away from the bottom surface of the lower case 17 and thus the conveyors 40 are moved in a floating manner. Namely, the conveyors 40 are moved to be away from the toner pushed and moved so that the toner is not pushed back, i.e., remains at the resulting position. By such substantial reciprocating movement of the stirring/conveying plate 24, as indicated by the arrows in FIG. 8, the toner is conveyed from the powder inlet 15 toward the sensor 32 and accumulated in the powder containing chamber 20.

Figure 10A:
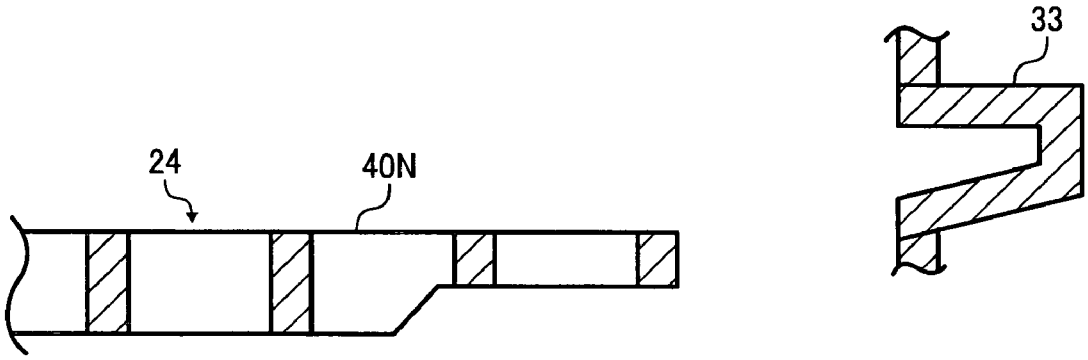
FIGS. 10A and 10B are partial views of a modification of the stirring/conveying plate.
Figure 10B:
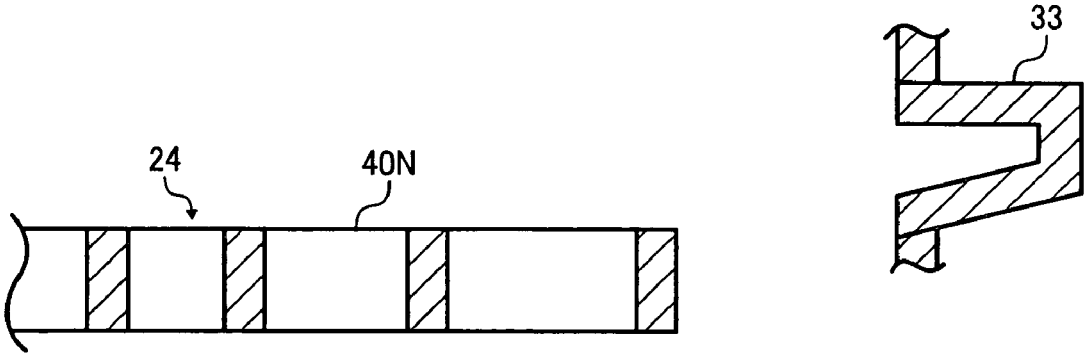

As shown in FIGS. 10A and 10B, the conveying force of the powder conveying unit 21 can be made weaker near the sensor chamber 33 than in other positions by modifying the cross-sectional configuration of conveyor 40N of the stirring/conveying plate 24 near the sensor such as by lowering the height of the conveying member (FIG. 10A) and by roughening the pitch of the conveying member (FIG. 10B). The toner flow and pulsation caused by the powder conveying unit 21 are suppressed and the excess flow of the toner into the sensor chamber 33 is prevented. The prevention of wrong detection of the sensor 32 can be improved.

The operation of the embodiment is explained next. The drive gear 26 is driven by the drive source of the image forming apparatus and the camshaft 25 is rotated. The stirring/conveying plate 24 then reciprocates substantially in the horizontal direction as shown in FIG. 4. Toner charged from the powder inlet 15 and stored in the powder collecting box 14 is stirred and conveyed by the stirring/conveying plate 24. In the conveyor 40A, the toner receives the conveying force as indicated by the arrows in FIG. 8 to be conveyed while stirred from the space immediately below the powder inlet 15 toward the middle of the powder containing chamber 20. In the conveyors 40B, 40E, and 40F, the toner is conveyed substantially in the same manner with slightly weakened conveying force. In the conveyors 40C, 40D, and 40H, the toner receives the conveying force indicated by the arrows to be conveyed gradually toward the front of the powder containing chamber 20. When the conveyance of the toner stops at the front of the powder containing chamber 20, the toner is then accumulated. The toner is gradually accumulated in the powder containing chamber 20. Even if the toner conveyed by the conveyors 40G and 40J attempts to flow toward the conveyors 40M and 40N, the toner is blocked by the partition 42 and cannot flow in the toner storing/accumulating chamber 35. When the toner is accumulated up to the space immediately below the conveyors 40G and 40J, the toner cannot move further forward and is conveyed to the space immediately below the conveyors 40I and 40L transversely adjacent to the conveyors 40G and 40J. The toner charged from the powder inlet 15 is transported by the conveying force as indicated by the arrows in FIG. 8 to a region 1 and then a region 2 shown in FIG. 11 in numerical order. The toner does not flow in a region 4 where the toner storing/accumulating chamber 35 is placed.

Figure 11:
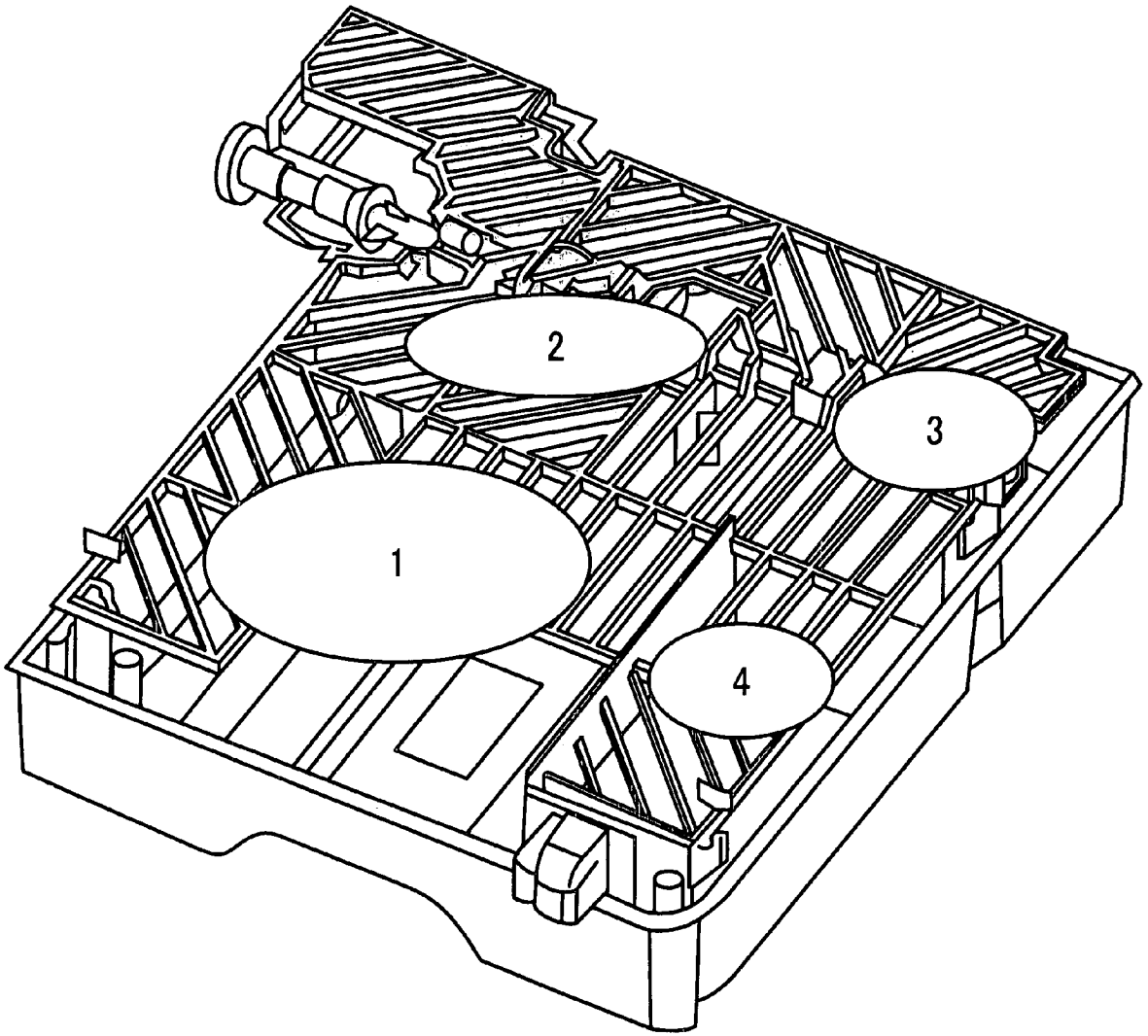
FIG. 11 is a schematic diagram for explaining an operation of the embodiment.

The toner conveyed to the space immediately below the conveyor 40L flows over the partition 36 for shuttering toner into the toner storing/accumulating chamber 35 surrounded by the partitions 36 and 37 and then is accumulated therein. The toner flown into the toner storing/accumulating chamber 35 and accumulated therein is conveyed gradually toward the front of the toner storing/accumulating chamber 35 and enters the sensor chamber 33 communicating with the toner storing/ accumulating chamber 35. Namely, when the regions 1 and 2 shown in FIG. 11 are filled with toner, the toner flows in a region 3 and then the region 4 by the conveying force of the conveyors 40L and 40M, and reaches the sensor chamber 33 including the sensor 32. Unless the upper surface level of the toner entering the sensor chamber 33 does not reach the sensor position, the toner entered slides down the bottom surface 33*a* to fall in the toner storing/accumulating chamber 35. In the sensor chamber 33, the excessively flown toner slides off the bottom surface 33*a* formed as the inclined surface. The full state of the toner is not detected unless the sensor chamber 33 is truly filled with toner. The toner remaining in the sensor chamber 33 is prevented reliably. The wrong detection as in the conventional cases hardly occurs and the full state is detected when the sensor chamber is filled with toner so that the toner covers the bottom surface 33*a*. The detection is thus more accurate. The time when the powder collecting box 14 is replaced is determined accurately and cannot be earlier unlike the conventional cases.

When the sensor chamber 33 is almost filled with toner, the sensor 32 detects such state and informs that the powder collecting box 14 becomes full by appropriate methods. Based on the information, users replace the powder collecting box with a new one.

Figure 12:
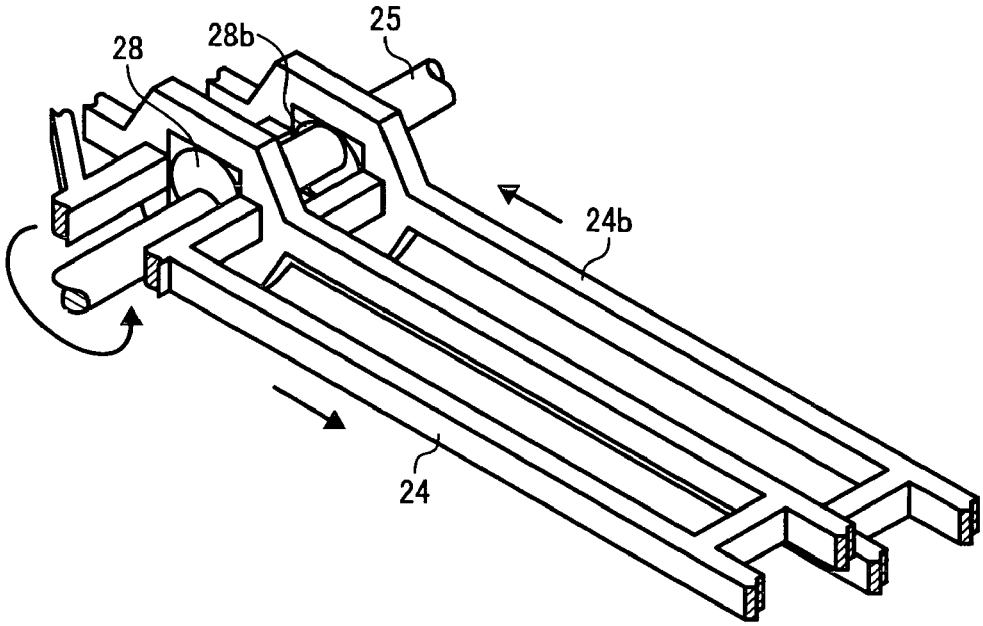
FIG. 12 is a perspective view of relevant parts of another embodiment of the present invention.
Figure 13:
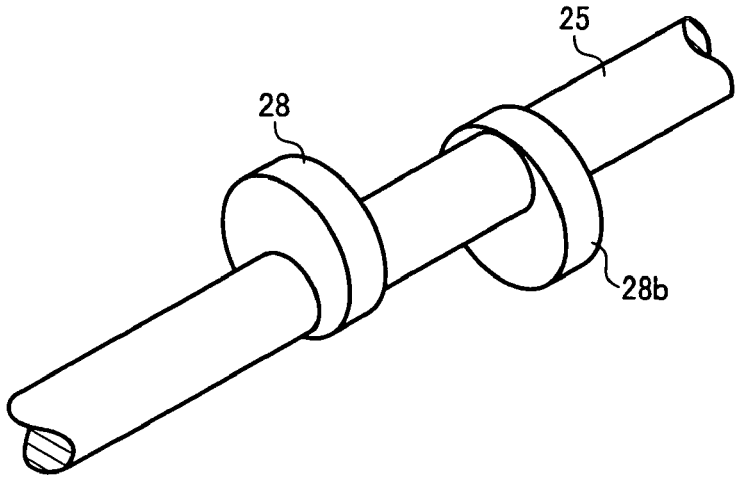
FIG. 13 is a perspective view of a part of a camshaft.

FIGS. 12 and 13 depict another embodiment of the present invention. FIG. 12 is a perspective view of relevant parts of stirring/conveying plates used in the embodiment. FIG. 13 is a perspective view showing a part of the camshaft engaging with the stirring/conveying plates. The basic configuration of the present embodiment is different from that of the above embodiment in that a plurality of (two) stirring/conveying plates are provided. Other configurations are substantially the same as in the above embodiment. According to the present embodiment, an eccentric cam 28*b* whose phase is shifted by about 180° with respect to the eccentric cam 28 for driving the stirring/conveying plate 24 to reciprocate substantially is provided at the camshaft 25. A stirring/conveying plate 24*b* driven by the eccentric cam 28*b* in substantial reciprocating directions is provided near the stirring/conveying plate 24 to be stacked vertically.

According to the present embodiment, when the camshaft 25 is rotated, the stirring/conveying plates 24 and 24*b* reciprocate in opposite directions as indicated by the arrows in FIG. 12 based on the positional relationship between the two eccentric cams 28 and 28*b*. When the conveyor of the stirring/conveying plate 24 near the sensor transports toner in the direction indicated by the lower arrow in the drawing, the conveyors of the stirring/conveying plate 24*b* transport the toner in the direction opposite to the lower arrow direction by 180°, as indicated by the upper arrow in the drawing. The toner conveying forces are balanced, so that the pulsation of toner caused by the substantial reciprocating movements of conveyors of the stirring/conveying plate 24 is suppressed. The toner hardly enters excessively the sensor chamber 33 and the prevention of the wrong detection in the sensor 32 is improved.

Because a plurality of the stirring/conveying plates 24 and 24*b* are used, toner is stirred more efficiently and conveyed while equalized slowly. Further, a single unit of the camshaft 25 reciprocating in the substantially horizontal direction will suffice and the configuration is not complicated. Therefore, an increase in manufacturing costs can be avoided.

The powder collecting box 14 serving as the powder container described in the embodiments is merely a preferred example and it is not intended that other types of containers with different configurations are excluded. The structures and configurations of the stirring/conveying plates 24 and 24*b* constituting the powder conveying unit are merely examples and any plates can be utilized as long as they can convey toner. Other configurations of the sensor chamber 33 can be also used, and detailed designs of the present invention can be changed and modified within the scope of the appended claims.

Characteristic effects of the present invention are explained below. According to the present invention, the angle at which the bottom surface of the sensor chamber is inclined is larger than the resting angle of powder stored in the powder container. Remaining of excessively flown toner in the sensor chamber is prevented reliably. The prevention of wrong detection of the sensor is further improved.

As described above, according to an aspect of the present invention, the partitions that prevent powder from entering the sensor until the required amount of powder is accumulated in the powder containing chamber are provided in the powder containing chamber near the sensor chamber. The powder pulsation caused by the powder conveying unit and the powder flow toward the sensor chamber are thus shuttered temporarily. The powder flow into the sensor chamber is prevented until a sufficient amount of powder is accumulated in the powder containing chamber. The wrong full state detection of the sensor at low capacity is thus prevented.

Furthermore, according to another aspect of the present invention, the powder conveying unit includes the stirring/conveying plate placed in the powder containing chamber to reciprocate substantially in the horizontal direction. The stirring/conveying plate includes, on its plane, a plurality of the conveyors that transport powder from the entrance toward the sensor chamber by the substantial reciprocating movement and the partition for preventing powder from entering the sensor chamber until the required amount of powder is accumulated in the powder containing chamber. The heights of the partitions provided in the powder containing chamber can be restricted by the powder conveying unit placed above (or below) the partitions and toner may not be shuttered sufficiently. The partition provided in the stirring/conveying plate accomplishes the same effects as the higher partitions. Accordingly, the prevention of the wrong full state detection at low capacity is improved.

Moreover, according to still another aspect of the present invention, the partition is formed by making the bottom surface or a roof of the powder containing chamber convex. Components around the waste toner box (e.g., feed roller) can enter the concave on the outer surface of the powder containing chamber. The apparatus is thus made compact. Alternatively, a powder containing chamber with a larger volume can be formed.

Furthermore, according to still another aspect of the present invention, the conveying force of the powder conveying unit near the sensor chamber is made weaker than in other positions. The powder pulsation caused by the powder conveying unit is thus suppressed and powder hardly enters the sensor chamber excessively. Accordingly, the wrong detection of the sensor is prevented.

Moreover, according to still another aspect of the present invention, a part of conveying force of the powder conveying unit is directed to the opposite direction. The conveying forces are thus offset and the pulsation caused by the reciprocating movement of the conveyor is suppressed. Accordingly, powder hardly enters the sensor chamber excessively, and the wrong detection of the sensor is prevented.

Furthermore, according to still another aspect of the present invention, a plurality of the stirring/conveying plates are provided to be stacked vertically. The stirring/conveying plates adjacent to each other vertically reciprocate substantially in opposite directions to convey powder. Toner is thus stirred more efficiently and conveyed while equalized slowly.

Moreover, according to still another aspect of the present invention, the sensor chamber is not affected by the powder flow and pulsation due to the powder conveying unit, and the wrong full state detection of the sensor at low capacity is prevented. The time when the powder container is replaced is determined more accurately than the conventional cases, resulting in an increase in user's convenience.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder container comprising:

a powder containing chamber including a powder inlet;

a powder conveying unit that conveys powder input from the powder inlet of the powder containing chamber into the powder containing chamber; and a powder detecting unit that detects a full state of the powder in the powder containing chamber, wherein, a sensor chamber is provided outside the powder containing chamber connected with each other, the powder detecting unit is provided in the sensor chamber, the powder conveying unit is separated from the powder detecting unit throughout the conveying the powder, a bottom surface of the sensor chamber is at higher level than a bottom surface of the powder containing chamber, and the bottom surface of the sensor chamber is inclined downward toward the powder containing chamber.

2. The powder container according to claim 1, wherein an angle of inclination of the bottom surface of the sensor chamber with respect to the bottom surface of the powder containing chamber is equal to or larger than an angle of rest of the powder contained in the powder container.

3. The powder container according to claim 1, further comprising a partition for preventing the powder from entering the sensor chamber until a required amount of powder is accumulated in the powder containing chamber, the partition being provided in the powder containing chamber near the sensor chamber.

4. The powder container according to claim 3, wherein the powder conveying unit includes a stirring/conveying plate arranged in the powder containing chamber in a reciprocating manner substantially in a horizontal direction, and the stirring/conveying plate includes, on its plane area, a plurality of conveyors that convey the powder from the powder inlet toward the sensor chamber by a substantial reciprocating movement.

5. The powder container according to claim 4, wherein the partition is configured by making either one of the bottom surface and a roof of the powder containing chamber convex.

6. The powder container according to claim 1, wherein conveying force of the powder conveying unit is weaker near the sensor chamber than in other positions.

7. The powder container according to claim 6, wherein a part of the conveying force of the powder conveying unit is directed to an opposite direction.

8. The powder container according to claim 4, wherein a plurality of stirring/conveying plates are provided to be stacked vertically, and the stirring/conveying plates vertically adjacent to each other reciprocate in opposite directions to convey the powder.

9. The powder container according to claim 1, wherein the powder is residual toner that is remained on a photosensitive element or an intermediate transfer element after transferring a toner image to a recording medium or an intermediate transfer body in an image forming apparatus that forms an image on a recording medium in an electrophotographic manner.

10. An image forming apparatus that forms an image on a recording medium in an electrophotographic manner, the image forming apparatus comprising:

a powder container that includes a powder containing chamber including a powder inlet;

a powder conveying unit that conveys powder input from the powder inlet of the powder containing chamber into the powder containing chamber; and a powder detecting unit that detects a full state of the powder in the powder containing chamber, wherein, a sensor chamber is provided outside the powder containing chamber connected with each other, the powder detecting unit is provided in the sensor chamber, the powder conveying unit is separated from the powder detecting unit throughout the conveying the powder, a bottom surface of the sensor chamber is at higher level than a bottom surface of the powder containing chamber, and the bottom surface of the sensor chamber is inclined downward toward the powder containing chamber.

11. The image forming apparatus according to claim 10, wherein an angle of inclination of the bottom surface of the sensor chamber with respect to the bottom surface of the powder containing chamber is equal to or larger than an angle of rest of the powder contained in the powder container.

12. The image forming apparatus according to claim 10, further comprising a partition for preventing the powder from entering the sensor chamber until a required amount of powder is accumulated in the powder containing chamber, the partition being provided in the powder containing chamber near the sensor chamber.

13. The image forming apparatus according to claim 12, wherein the powder conveying unit includes a stirring/conveying plate arranged in the powder containing chamber in a reciprocating manner substantially in a horizontal direction, and the stirring/conveying plate includes, on its plane area, a plurality of conveyors that convey the powder from the powder inlet toward the sensor chamber by a substantial reciprocating movement.

14. The image forming apparatus according to claim 13, wherein the partition is configured by making either one of the bottom surface and a roof of the powder containing chamber convex.

15. The image forming apparatus according to claim 10, wherein conveying force of the powder conveying unit is weaker near the sensor chamber than in other positions.

16. The image forming apparatus according to claim 15, wherein a part of the conveying force of the powder conveying unit is directed to an opposite direction.

17. The image forming apparatus according to claim 13, wherein a plurality of stirring/conveying plates are provided to be stacked vertically, and the stirring/conveying plates vertically adjacent to each other reciprocate in opposite directions to convey the powder.

18. The image forming apparatus according to claim 10, wherein the powder is residual toner that is remained on a photosensitive element or an intermediate transfer element after transferring a toner image to a recording medium or an intermediate transfer body.

19. A powder container comprising:

a powder containing chamber including a powder inlet;

a powder conveying unit that conveys powder input from the powder inlet of the powder containing chamber into the powder containing chamber; and a powder detecting unit that detects a full state of the powder in the powder containing chamber, wherein, a sensor chamber is provided outside the powder containing chamber connected with each other, the powder detecting unit is provided in the sensor chamber, a conveying force of the powder conveying unit is weaker near the sensor chamber than in other positions, a bottom surface of the sensor chamber is at higher level than a bottom surface of the powder containing chamber, and the bottom surface of the sensor chamber is inclined downward toward the powder containing chamber.

* * * * *